US011096448B1

(12) United States Patent
Hodge et al.

(10) Patent No.: US 11,096,448 B1
(45) Date of Patent: Aug. 24, 2021

(54) HIDDEN CONNECTION INTERCHANGEABLE TONGUE

(71) Applicants: Raenelle Hodge, Elizabeth, NJ (US); Kirtley Hodge, Elizabeth, NJ (US)

(72) Inventors: Raenelle Hodge, Elizabeth, NJ (US); Kirtley Hodge, Elizabeth, NJ (US)

( * ) Notice: Subject to any disclaimer, the term of this patent is extended or adjusted under 35 U.S.C. 154(b) by 0 days.

(21) Appl. No.: 16/840,397

(22) Filed: Apr. 5, 2020

(51) Int. Cl.
*A43B 23/26* (2006.01)

(52) U.S. Cl.
CPC ..... *A43B 23/26* (2013.01)

(58) Field of Classification Search
CPC ..... A43B 23/26; A43B 3/0078
USPC ..... 36/54
See application file for complete search history.

(56) References Cited

U.S. PATENT DOCUMENTS 1,572,313 A * 2/1926 Sarar ..... A41D 17/00 36/1.5
2,420,239 A * 5/1947 Hack ..... A43C 1/006 36/99
3,475,835 A * 11/1969 Kovar ..... A43B 5/0415 36/1.5
4,255,876 A * 3/1981 Johnson ..... A43B 5/00 36/129
4,958,447 A * 9/1990 DuPree ..... A43B 3/242 36/100
5,088,166 A * 2/1992 Lavinio ..... A43C 1/00 24/712
6,408,542 B1 * 6/2002 Shepherd ..... A43B 5/00 36/114
8,065,821 B1 * 11/2011 Reid ..... A43C 11/06 36/100
8,959,803 B2 * 2/2015 Pelletier, Jr. ..... A43B 23/26 36/99
2002/0029494 A1 * 3/2002 Small ..... A43B 23/24 36/54
2009/0249650 A1 * 10/2009 Sarantakos ..... A43B 3/0078 36/101
2020/0268103 A1 * 8/2020 Levy ..... A43B 21/52

* cited by examiner

*Primary Examiner* — Ted Kavanaugh
(74) *Attorney, Agent, or Firm* — Michael J. Feigin, Esq.; Feigin and Fridman LLC

(57) ABSTRACT

A tongue of an article of footwear is split into two pieces having an upper and lower section. The lower section is built into/a part of the footwear as it is fixedly attached to a vamp and/or throat of the footwear such as of a sneaker. The upper end is removably attachable to the footwear along a straight line (line of demarcation) between the upper and lower pieces. This straight line extends generally horizontally. The upper end of the lower region of the tongue and the lower end of the upper region of the tongue have fastening mechanisms designed/configured to removably attach the upper and lower regions to each other along a horizontal axis.

7 Claims, 4 Drawing Sheets

HIDDEN CONNECTION INTERCHANGEABLE TONGUE

FIELD OF THE DISCLOSED TECHNOLOGY

The disclosed technology relates generally to footwear, and more specifically to interchangeable tongues of footwear.

BACKGROUND

Changeable clothing, clothing which can have parts removed and others added with a different look, are well represented in the U.S. Patent database. With footwear, many references are known which allow for charms to be added, removed, or the like. A drawback to many of these references is that the changes appear unnatural. One can easily tell that "it looks strange." There's something different about, for example, an article of clothing that has a big seam, zipper, or snaps in the middle of a length of fabric where one ordinarily would not find same.

What is needed in the art is a way to make clothing changeable while also appearing natural and as if the entire piece of apparel or footwear was actually produced as a single unit and/or looks "natural."

SUMMARY OF THE DISCLOSED TECHNOLOGY

A tongue of an article of footwear is split into two pieces having an upper and lower section. The lower section is built into/a part of the footwear. This is by way of fixed attachment to a vamp and/or throat of the footwear such as of a sneaker. The upper end is removably attachable to the footwear along a straight line between the upper and lower pieces extending horizontally (relative to the longest length of the tongue which is "vertical" for purposes of this disclosure; e.g. vertical is generally from the back to the front of the footwear and horizontal is from side to side). The upper end of the lower region of the tongue, and the lower end of the upper region of the tongue have fastening mechanisms designed/configured to removably attach the upper and lower regions to each other along a horizontal axis.

The above configuration and removable connection between the upper and lower regions creates one or both of a visible horizontal line where the upper region ends and the lower region begins (from the viewpoint of one looking down on the shoe) and/or a visible fastener, such as top ends of snap fasteners or stitching. Thus, the upper end of the lower region and/or lower end of the upper region (where the regions are connected) are covered between a first left eyelet and a first right eyelet of the footwear. An "end" is within 5% and 12% of a total length of the tongue, the end size being based on the size of a fastener, shoes, and shoelaces used in order to calibrate the hiding thereof. The covering of the ends (and/or visible regions of the connectors/fasteners/fastening mechanisms) is accomplished by the position of the shoelaces which extend between the left and right eyelets. In this manner, a set of left/right eyelets and laces extending there-between cover or substantially cover a line of demarcation which is otherwise visible such as a part of the line between the left and right quarters of the shoe.

The laces further, when within the eyelets, put pressure on the tongue and hold the tongue against a foot of a wearer such that the line of demarcation remains hidden during use of the shoe by a wearer thereof. A part of each of the first and second fastening mechanisms are held under a left and ride side quarter of the article of footwear in some embodiments such that a combination of the laces and quarters of the shoe hide the line of demarcation from view.

The tongue, to an ordinary observer looking at the shoe worn by another, appears to be a unitary piece tongue due to covering of the line of demarcation, the first fastening mechanism, and the second fastening mechanism. The tongue can have raised indicia/indicium on a front (top) side thereof. (The "front" is a portion which points towards the front of the shoe though depending on the angle of the particular shoe it may face forwards or upwards or very often, in a direction between forward and upwards.) Visual indicators of there being a separate upper region and the lower region are at least mostly obstructed from view by laces extending above the tongue of the shoe. These visual indicators (a viewable distinguishing mark showing non-continuity of a tongue) are further covered by a left and right quarter of he shoe and/or are completely obstructed from view by a combination of laces and quarters of the shoe in some embodiments of the disclosed technology.

One can use the devices described above by attaching an upper end of a part of a tongue fixedly part of a shoe to a second part of the tongue (an upper region of the tongue) to the lower region. The size of the upper and lower region can vary as long as the point of overlap and/or line of demarcation is substantially at or is at a location between two eyelets on either side thereof. One then places the upper end of the lower region substantially between a left and right eyelet of the article of footwear.

One can also arrange visual indicators of the upper region and the lower region such that they are at least mostly (51%+), substantially (95%+), or fully/exactly (99.5%+) obstructed from view by laces alone or conjunction with faces of the shoe, each of which extends above the tongue of the shoe.

Any device or step to a method described in this disclosure can comprise or consist of that which it is a part of, or the parts which make up the device or step. The term "and/or" is inclusive of the items which it joins linguistically and each item by itself.

DETAILED DESCRIPTION OF EMBODIMENTS OF THE DISCLOSED TECHNOLOGY

A tongue of an article of footwear is split into two pieces having an upper and lower section. The lower section is built into/a part of the footwear as it is fixedly attached to a vamp and/or throat of the footwear such as of a sneaker. The upper end is removably attachable to the footwear along a straight line (line of demarcation) between the upper and lower pieces. This straight line extends generally (what an ordinary observer who is neuro-typical consider as such) horizontally. The upper end of the lower region of the tongue and the lower end of the upper region of the tongue have fastening mechanisms designed/configured to removably attach the upper and lower regions to each other along a horizontal axis.

Embodiments of the disclosed technology will become clearer in view of the following description of the figures.

Figure 1:
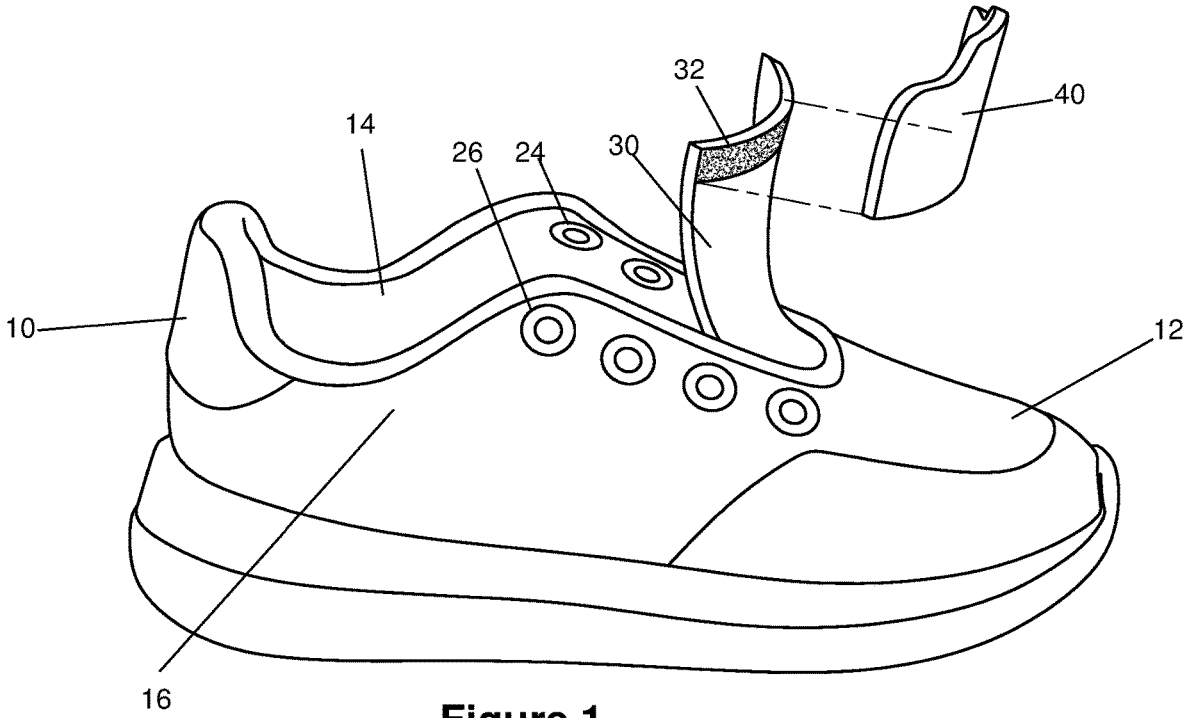
FIG. 1 is a side perspective view of an article of footwear with a two-part tongue of an embodiment of the disclosed technology.

FIG. 1 is a side perspective view of an article of footwear with a two-part tongue of an embodiment of the disclosed technology. The footwear, shown here as a sneaker, has a toe 12 (front) opposite a rear side 10 (the top most portion thereof being the topline). These are connected by a left quarter 14 and right quarter 16 (left and right sides of the shoe). At the upper/top side of the quarter (the facing) are a plurality of eyelets on each side, including a left eyelet 24 and right eyelet 26. A partial tongue or lower section of a tongue 30 is fixedly attached to the shoe at an interior the shoe such as under one or more of the shoe's throat, facing, and/or quarter. A "quarter" is part of the shoe's upper which covers the sides and back of the foot behind the vamp. The "throat" of a shoe is the quarters meet at an eye-stay. A "vamp" is a section of the shoe which covers the front of the foot towards the back, joining with the quarter. Such terms can also be understand based on their well known definitions in the art.

Referring to the tongue further, the tongue can be tucked under the left and right quarters and be partially hidden thereby. A middle region, which lacks covering by the quarters of the shoe, is then visible to one looking down from above the shoe. Shoelaces cover some of the tongue though in many embodiments, the tongue is at least partially visible under the shoelaces. Here, the tongue is in two parts, a lower region or section 30 and an upper region or section 40. The upper region 40 is removable from the lower section, where "removable" is defined as "designed to and/or which does attach and detach at least 100 times with a substantial lack of degradation to the pieces such that they continue to function as intended." In this manner, one can remove and replace the top region or section 40 of the tongue. The top and bottom regions have a continuous width with each other in embodiments of the disclosed technology while the length of a traditional tongue is the combined length of the top and bottom 40 and 30 of the tongue in the disclosed technology herein.

The tongue has a connecting region at the top edge 32 of the lower portion 30 and a bottom edge of the upper portion 40. These edges overlap when the upper and lower tongue are connected (removably) to each other. This forms a horizontal line where the upper portion 40 ends and the lower portion 30 becomes visible. The upper portion may also form a "bump" over the lower portion such that it extends upwards or frontally more than the lower portion at the line of demarcation. This noticeable connection line and/or fastening mechanisms, when viewed by another, makes it apparent that the tongue is split into two parts or is otherwise different than a unitary tongue. This is so even with a Velcro (hook and loop fastening device) which, in some embodiments, lacks visibility from above the shoe because there is still a visible line of demarcation, extra stitching, and so forth.

Figure 2:
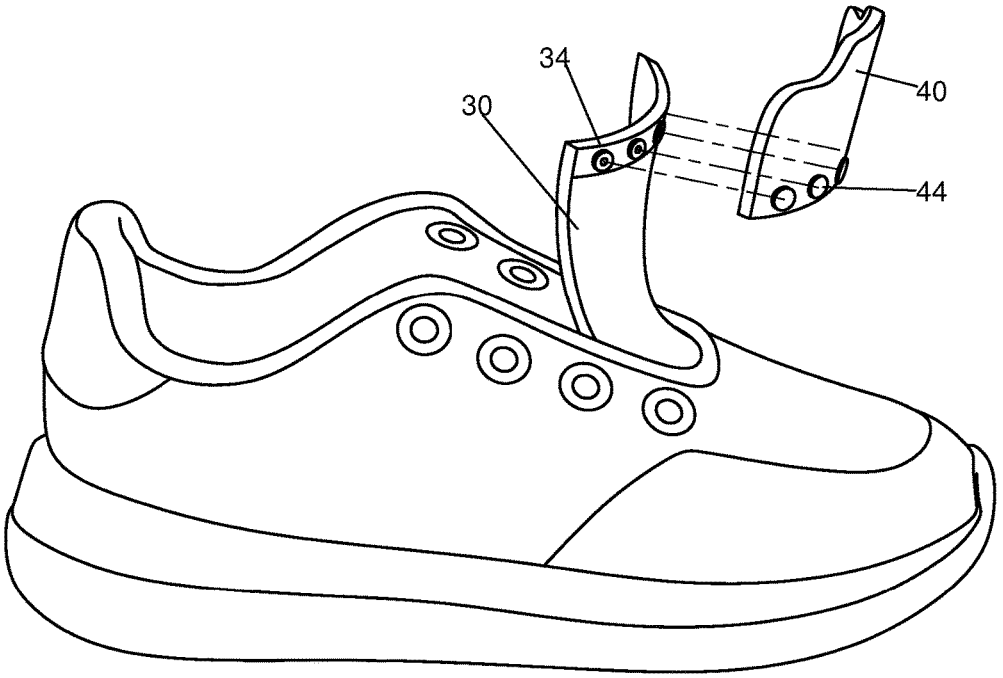
FIG. 2 is a side perspective view of an article of footwear with a two-part tongue with snap fasteners in an embodiment of the disclosed technology.

FIG. 2 is a side perspective view of an article of footwear with a two-part tongue with snap fasteners in an embodiment of the disclosed technology. Here, the differences from that of FIG. 1 are that of the fastening mechanism and visibility of same. The fastening mechanism here are a series of male snaps 34 and female snaps 44. While convenient for use and able to be removed and replaced perhaps tens of thousands of times, a downside of snaps is that one must either add bulk/additional layers which make the snaps more difficult to use and deepen the tongue. This is in order to hide the snaps or, otherwise there are visible metal circles (or the equivalent) as can be seen in FIG. 2. In embodiments of this disclosed technology, this problem is solved while by covering the visible snaps or other indicia/noticeable parts of the connector, including a horizontal line of demarcation between the top and bottom, with the shoelaces of the shoe. This can be difficult because it requires calibration of the position of the snaps 44 or other visible indicia/lines with a position of the shoelaces. This is discussed with reference to the following figures.

Figure 3:
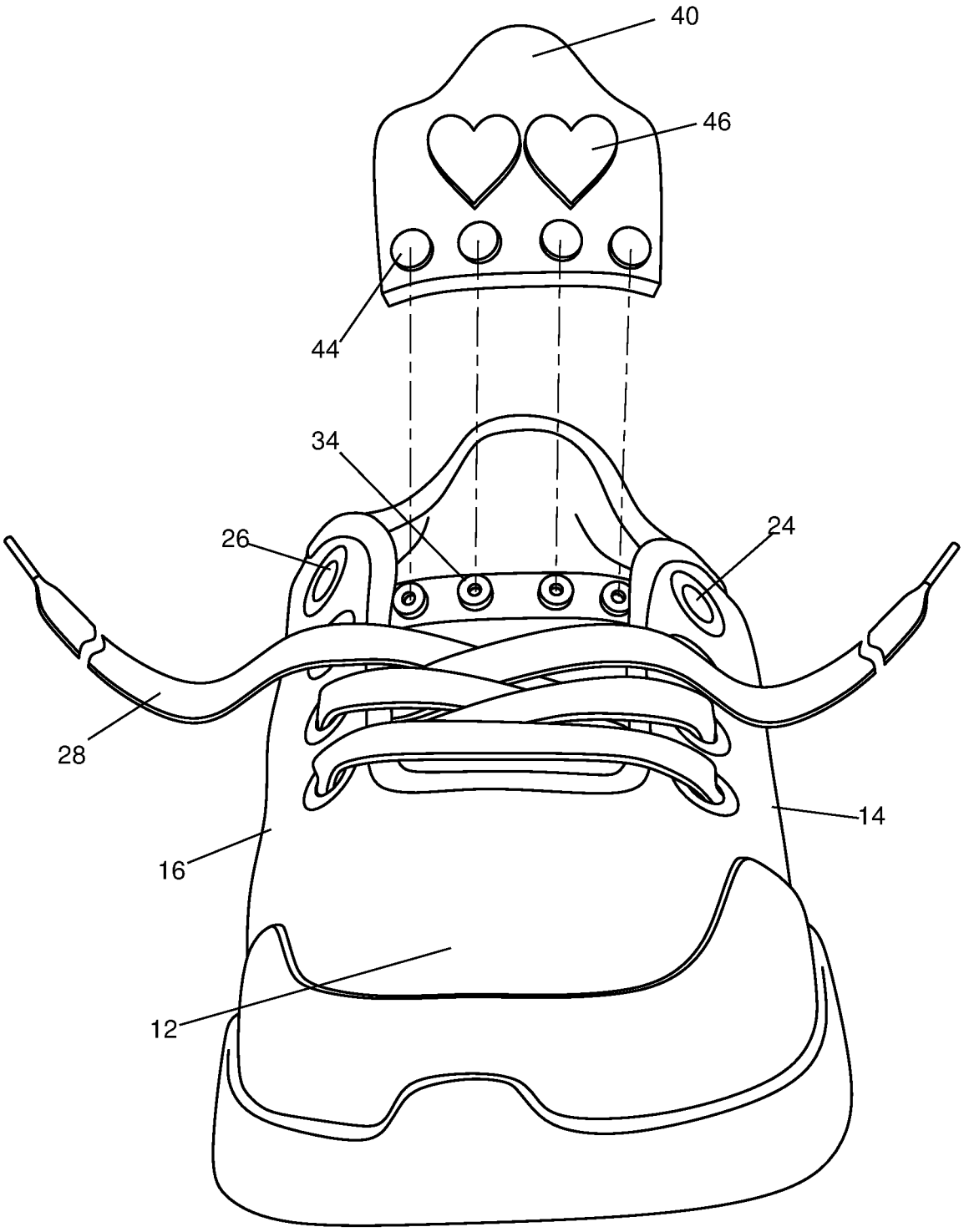
FIG. 3 is a front perspective view of the article of footwear of FIG. 2.

FIG. 3 is a front perspective view of the article of footwear of FIG. 2. Here, a different upper region 40 of the tongue is shown with visible indicia 46 which are raised from the top plane of the tongue. The bottom region 30 of the tongue is held under the left and right quarters 14 and 16 of the footwear. The laces 28 criss-cross between the eyelets. The lower portion of the tongue may be sewn into place parallel or substantially parallel to the eyelets on either side in order to make sure the fastening mechanism 34 is held in place relative to the eyelets 24 and 26. As such, one can remove and replace the upper tongue as desired with a different upper tongue 40 having different indicia or no indicia at all while the top edge of the lower tongue 30 and the fastening mechanism 34 is stationary or substantially stationary with two oppositely disposed eyelets, such as eyelets 24 and 26.

Figure 4:
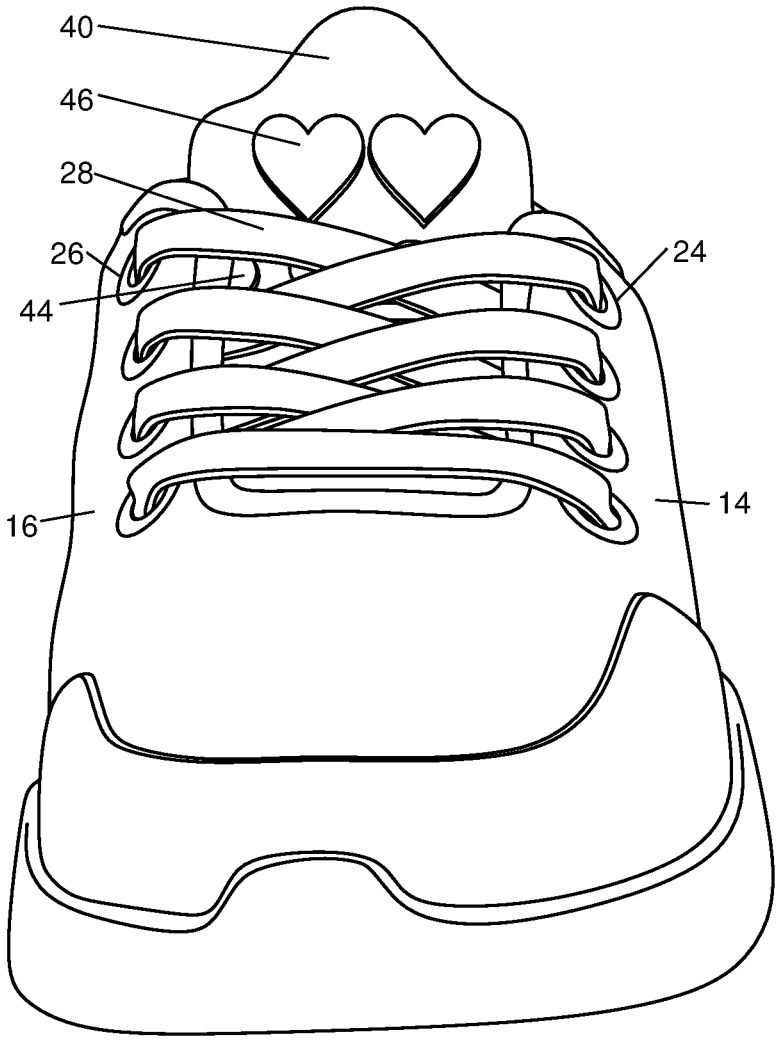
FIG. 4 is a front perspective view of the article of footwear of FIG. 3 where the snap fasteners are substantially hidden by shoelaces.

FIG. 4 is a front perspective view of the article of footwear of FIG. 3 where the snap fasteners are substantially hidden by shoelaces. Here, the shoelaces are fully laced up, or, at least laced through two eyelets 24 and 26 which are stationary with respect to the visible regions of the fastening mechanism 44 when the fastening mechanism of the upper region of the tongue is removably fastened to the fastening mechanism of the lower region of the tongue. The fastening mechanism can be exactly between a line extending straight (or curvilinearly and directly there-across based on the shape of the upper of the shoe) between two eyelets or offset from such a line in order that the crossing shoelaces 28 better cover same. In such an embodiment, the fastening mechanism 44 is substantially covered though further coverage is possible.

Figure 5:
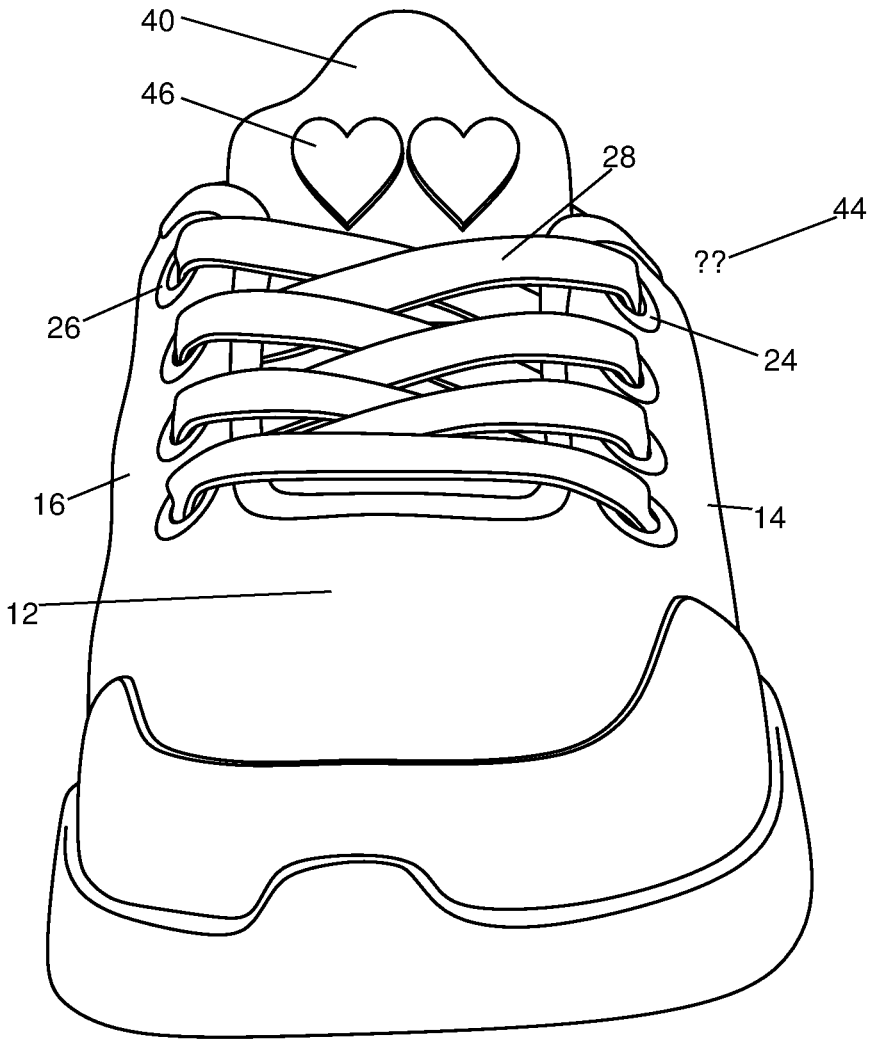
FIG. 5 is a front perspective view of the article of footwear of FIG. 3 where the fasteners are fully hidden by shoelaces.

FIG. 5 is a front perspective view of the article of footwear of FIG. 3 where the fasteners are fully hidden by shoelaces. Here, the laces are completely covering the fastening mechanism 44 such that it can't be seen and the draftsman drew lines to two question marks. It adds to the ambiance and point of the invention in the first place so it's there for the public to see. The fastening mechanism(s) 44 are fully hidden in this shoe at rest, and in some embodiments, while the shoe is in use and being compressed/twisted during normal such use known in the art. The laces 28 are completely covering a section of the fastening mechanism which is between the quarters (left/right sides) of the shoe. The fastening mechanism may be covered by any one or combination of shoelaces 28, quarter of the shoe 16, and quarter of the shoe 24.

In the embodiment shown, the fastening mechanisms 34 comprise snaps with upper portions in the upper tongue portion 40 and lower portions in the lower tongue portion 30. The upper portions of the snaps pass fully through the upper tongue portion 40, such that the upper portions of the snaps comprise upper planes which simultaneously comprise visible regions 44 of the fastening mechanisms 34. There are at least three fastening mechanisms 34, including at least one right-most fastening mechanism 34, at least one left-most fastening mechanism 34, and at least one central fastening mechanism 34. Each fastening mechanism 34 has a visible region/visible fastening mechanism indicator 44 corresponding there-to.

Any device or aspect of the technology can "comprise" or "consist of" the item it modifies, whether explicitly written as such or otherwise.

When the term "or" is used, it creates a group which has within either term being connected by the conjunction as well as both terms being connected by the conjunction.

While the disclosed technology has been disclosed with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. An article of footwear, comprising:

a tongue;

a lower region of said tongue forming a part of said footwear by way of fixed attachment to a vamp and/or throat of said footwear;

an upper end of said lower region having a first temporary fastening mechanism along a top end thereof;

an upper region of said tongue being removable from said lower region by way of a second temporary fastening mechanism;

wherein said upper end of said lower region extends substantially between a first left eyelet and a first right eyelet of said article of footwear;

wherein said upper region of said tongue further comprises a plurality of visible regions of fastening mechanisms such that each said respective visible regions of a fastening mechanism is in a location corresponding to a location of a respective temporary fastening mechanism;

wherein said plurality of visible regions of fastening mechanisms includes at least one right-most visible region of a fastening mechanism, at least one left-most visible region of a fastening mechanism, and at least one central visible region of a fastening mechanism between said right-most visible region and said left-most visible region;

wherein said article of footwear, excluding said upper region of said tongue, comprises a unitary structure;

wherein each said visible region of a fastening mechanism of said visible regions of fastening mechanisms comprises a head of a snap;

wherein said second temporary fastening mechanism is connected to said first temporary fastening mechanism and said tongue is at least partially held in place relative to said footwear by way of laces extending through a plurality of left eyelets and a plurality of right eyelets including said first left eyelet and said second right eyelet;

wherein said first and said second temporary fastening mechanisms are connected at a plurality of distinct points;

wherein said plurality of distinct points includes a left-most point corresponding to a position of said left-most visible region of a fastening mechanism, a right-most point corresponding to a position of said right-most visible region of a fastening mechanism, and at least one central point corresponding to a position of said central visible region of a fastening mechanism;

wherein a left-most and a right-most part of each of said first and said second fastening mechanisms as well as a part of each of said right-most and said left-most visible regions of fastening mechanisms are held under a left and right side quarter of said article of footwear;

wherein said at least one central visible region of a fastening mechanism and a central part of each of said first and said second fastening mechanisms are unencumbered by said left and said right side quarter of said article of footwear.

2. The article of footwear of claim 1, wherein said upper region covers said first temporary fastening mechanism of said lower region, creating a visible line of demarcation at a bottom end of said upper region at a top most extend of said lower region which is unobscured by said upper region;

wherein at least said left-most visible region of a fastening mechanism and said right-most visible region of a fastening mechanism is at least partially covered by a left and a right quarter of said article of footwear while at said at least one central visible region of a fastening mechanism is unobscured by said left and said right quarter of said article of footwear.

3. The article of footwear tongue of claim 2, wherein said tongue, appears to be a unitary piece tongue due to covering of said line of demarcation, said first fastening mechanism, and said second fastening mechanism at least, in part, by said laces.

4. The article of footwear tongue of claim 2, wherein said visible line of demarcation as well as substantially all said visible regions of fastening mechanisms of said plurality of visible regions of fastening mechanisms, are at least mostly obstructed from view by laces extending above said tongue of said article of footwear.

5. The article of footwear tongue of claim 2, wherein said visible line of demarcation and said plurality of visible regions of fastening mechanisms are completely obstructed from view by a combination of said laces, said left quarter, and said right quarter of said article of footwear.

6. The article of footwear of claim 2, wherein a majority of said visible line of demarcation which is uncovered by said left and said right quarter of said article of footwear is covered by laces of said footwear which pass through at least some of said plurality of said left eyelets and said plurality of said right eyelets.

7. The article of footwear of claim 1, wherein said tongue comprises raised indicia on a front side thereof;

wherein substantially all of said raised indicia is uncovered by said left quarter and said right quarter of said footwear and by said laces of said footwear.

* * * * *